US008929570B2

(12) United States Patent
Tao

(10) Patent No.: US 8,929,570 B2
(45) Date of Patent: Jan. 6, 2015

(54) SPEAKER

(71) Applicant: Shen Tao, Shenzhen (CN)

(72) Inventor: Shen Tao, Shenzhen (CN)

(73) Assignees: AAC Acoustic Technologies (Shenzhen) Co., Ltd., Shenzhen (CN); AAC Acoustic Technologies (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 13/945,841

(22) Filed: Jul. 18, 2013

(65) Prior Publication Data

US 2014/0023224 A1 Jan. 23, 2014

(30) Foreign Application Priority Data

Jul. 20, 2012 (CN) ..... 2012 2 0354941 U

(51) Int. Cl.
*H04R 25/00* (2006.01)
*H04R 1/02* (2006.01)

(52) U.S. Cl.
CPC ..... *H04R 1/02* (2013.01)
USPC ..... 381/189

(58) Field of Classification Search
USPC ..... 381/189, 333, 354, 365, 386, 388, 392, 381/395
See application file for complete search history.

(56) References Cited

U.S. PATENT DOCUMENTS

| | | | | |
|---|---|---|---|---|
| 2,256,689 | A * | 9/1941 | Quam | 381/420 |
| 2002/0008602 | A1 * | 1/2002 | Kyouno et al. | 335/220 |
| 2010/0304796 | A1 * | 12/2010 | Stohr et al. | 455/575.1 |

* cited by examiner

*Primary Examiner* — Matthew Eason
(74) *Attorney, Agent, or Firm* — IPro, Inc.; Na Xu

(57) ABSTRACT

A speaker includes a holder having a receiving cavity and an acoustic hole communicating with the receiving cavity, a magnetic circuit system received in the receiving cavity of the holder, and a guiding portion attached on the holder. Wherein at least a part of the guiding portion is exposed from an outer surface of the holder and disposed near the acoustic hole for guiding magnetic leakage leaked from the magnetic circuit system to attract the ferromagnetic material dust near the acoustic hole. The performance of the speaker is improved.

7 Claims, 3 Drawing Sheets

SPEAKER

FIELD OF THE INVENTION

The present invention generally relates to speakers, and more particularly, to a speaker having an acoustic hole for outputting sound waves.

RELATED ART OF THE INVENTION

Gradually, speakers are widely used in many types of portable electronic devices, such as mobile phones, notebook computers, hearing aids, for converting audio electrical signals to audible sounds.

Generally, a related speaker includes a frame having a receiving cavity, a magnetic circuit system received in the receiving cavity for forming a magnetic gap, a coil suspended in the magnetic gap, a diaphragm coupled with the coil with a peripheral edge thereof fixed to the frame, and an upper cover fixed to an upper side of the frame. In addition, the diaphragm faces the upper cover, with a room formed between the diaphragm, the frame and the upper cover. An acoustic hole is formed to communicating with the room and is provided for outputting sound waves produced by the diaphragm.

Such a basic configuration of the speaker is mentioned above. The acoustic hole is communicated with the external space directly, so the ferromagnetic material dust may enter the receiving cavity by attracting of magnetic leakage leaked from the magnetic circuit system via the acoustic hole, which will seriously affect the the performance of the speaker, and which is undesired.

Therefore, an improved speaker that can resolve the problems mentioned-above is desired.

DETAILED DESCRIPTION OF THE EXEMPLARY EMBODIMENT

Figure 1:
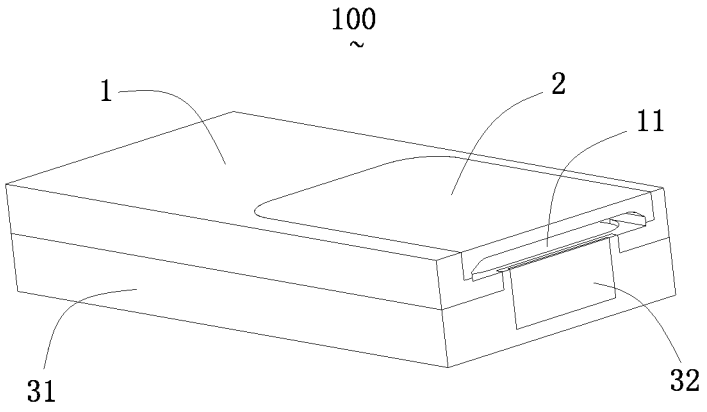
FIG. 1 is an illustrative assembled view of a speaker in accordance with an exemplary embodiment of the present invention.
Figure 2:
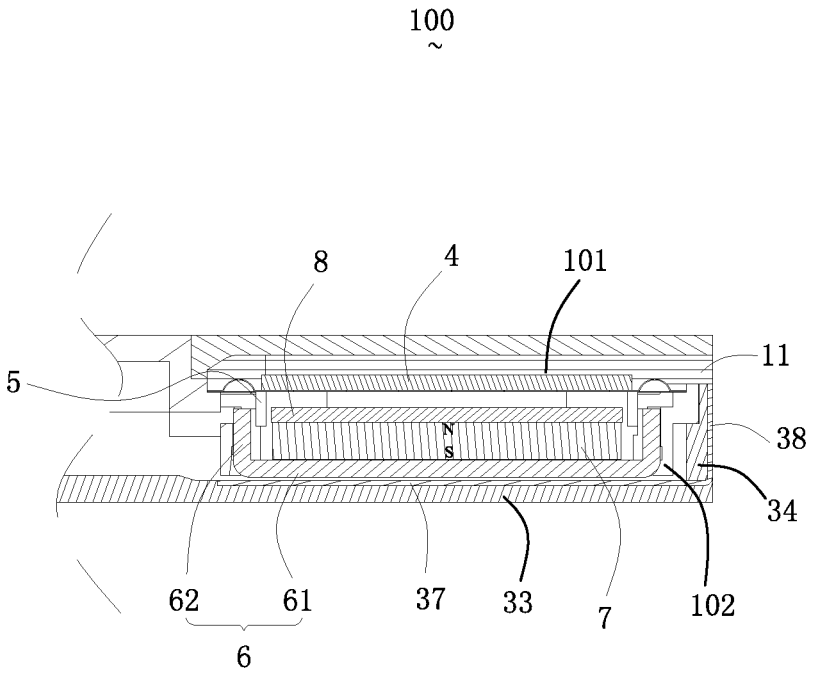
FIG. 2 is a cross-sectional view of the speaker, a holder and a guiding portion of the speaker is partially omitted.
Figure 3:
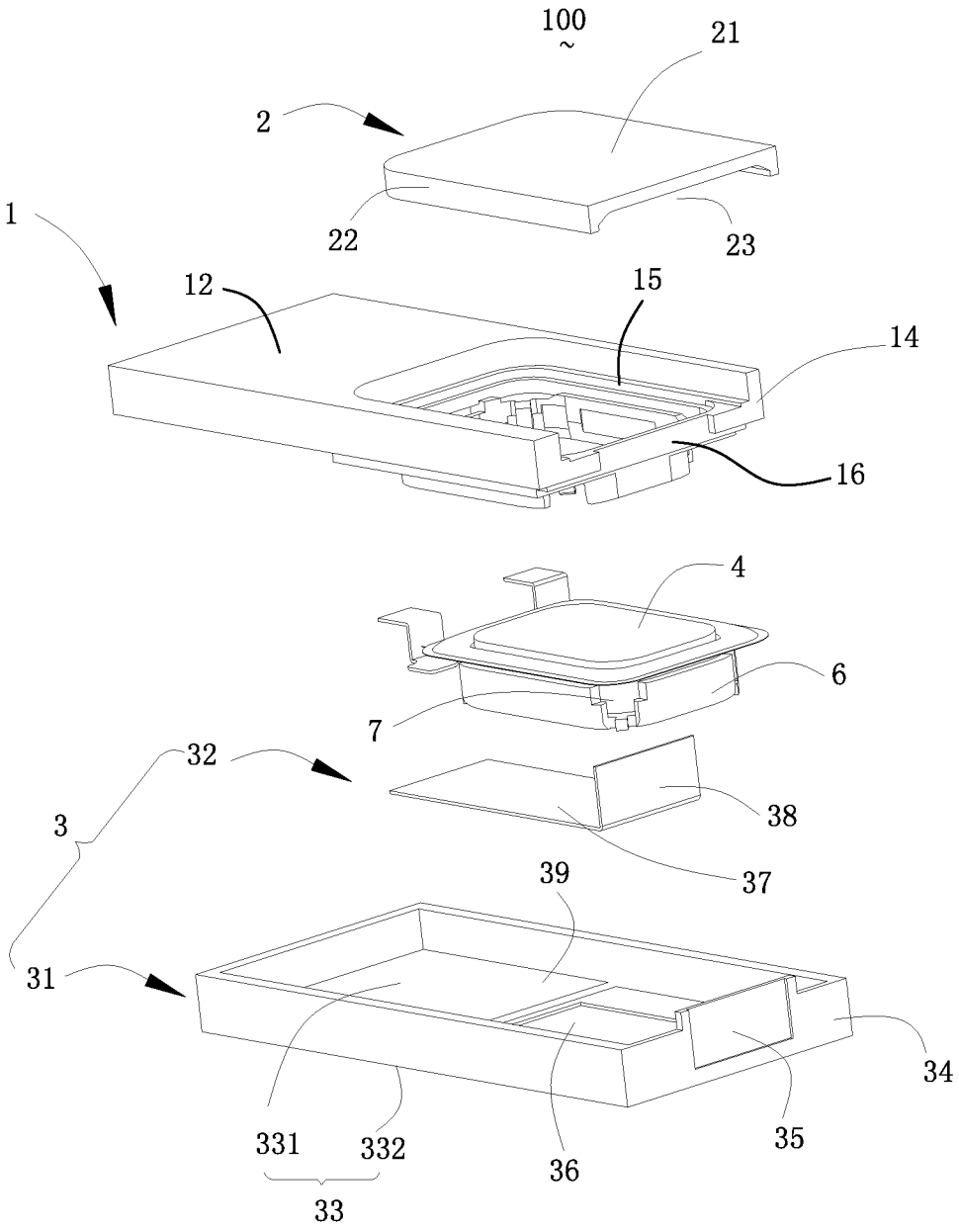
FIG. 3 is an exploded view of the speaker.
Figure 4:
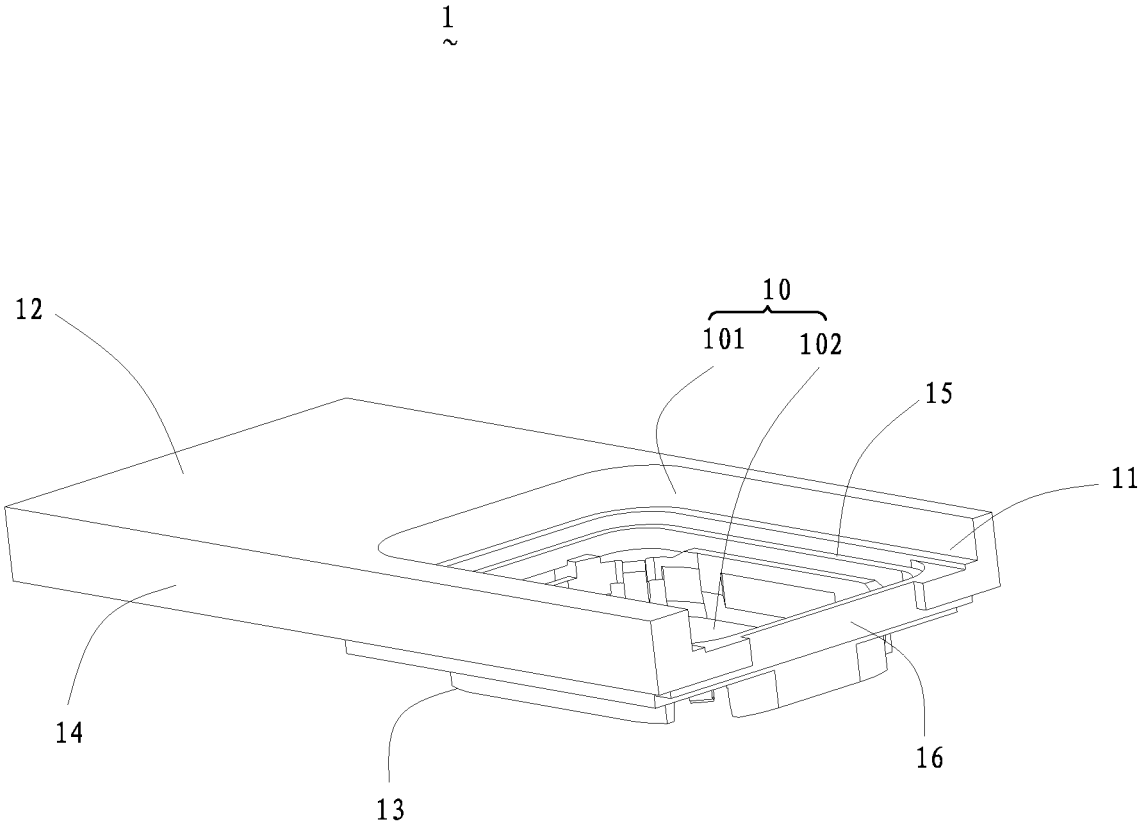
FIG. 4 is an illustrative isometric view of a frame of the speaker.

Embodiment of the present disclosure will now be described in detail below, with reference to the accompanying drawings. Referring to FIGS. 1-4, a speaker 100 comprises a magnetic circuit system, a vibrating system and a holder. The holder has a receiving cavity 10 for accommodating the magnetic circuit system and the vibrating system, and an acoustic hole 11 communicated with the receiving cavity 10. The speaker 100 further has a guiding portion 3 made of magnetic material and located near the acoustic hole 11.

The holder comprises a frame 1 and an upper case 2 mounted on the frame 1. The frame 1 has an upper surface 12, a lower surface 13 opposite to the upper surface 12, and a plurality of side wall 14 connecting the upper and lower surfaces 12 and 13. The receiving cavity 10 extends from the upper surface 12 towards the lower surface 13. The frame 1 further has a mounting portion 15 extending from the side wall 14 towards the receiving cavity 10 for dividing the receiving cavity 10 into a front cavity 101 and a rear cavity

102 communicating with the front cavity 101, and an engaging slot 16 provided on the side wall 14 near the acoustic hole 11. The acoustic hole 11 is formed complete through the side wall 14 and communicated with the front cavity 101 and the engaging slot 16.

The vibrating system has a diaphragm 4 mounted on the mounting portion 15 of the frame 1 and a voice coil 5 attached to the diaphragm 4 for driving the diaphragm 4 to vibrate. In fact, the voice coils can be directly connected to the diaphragm, and can also be connected to the diaphragm via a medium.

The upper case 2 has a top plate 21 facing the diaphragm 4 of the vibrating system, an extending wall 22 extending downwardly from the periphery of the top plate 21, and a first cavity 23 formed by the extending wall 22 together with the top plate 21. The extending wall 22 is fixed on the mounting portion 15 of the frame 1, so that the first cavity 23 is communicated with the front cavity 101.

In order to output sound waves produced by the diaphragm 4, the side wall 14 of the frame 1 has the acoustic hole 11 communicated with the front cavity 101. The acoustic hole 11 is designed as an opening of the front cavity 101 so that the air of the front cavity 101 can get out via the acoustic hole 11. In the present embodiment, the acoustic hole 11 is formed along a side direction of the diaphragm 4 and provided on the side wall 14 of the frame 1. That is to say, the acoustic hole 11 does not directly face the diaphragm 4. It is to be understood, in other embodiments, the acoustic hole is formed on the extending wall or the top wall of the upper case, or is formed on extending wall of the upper case and the side wall of the frame.

The magnetic circuit system is received in the rear cavity 102 of the receiving cavity 10 and has a yoke 6 engaged with the side wall 14 of the frame 1, a magnet 7 and a pole plate 8 mounted on the yoke 6, and a magnetic gap formed by the yoke 6 and the magnet 7. The yoke 6 is configured to be like a bowl and has a receiving space for accommodating the magnet 7 and the pole plate 8. The yoke 6 further has a seating portion 61 and a bending portion 62 extending upwardly from the seating portion 61 for cooperatively forming the receiving space. The magnet 7 is positioned on the seating portion 61 of the yoke 6 and the pole plate 8 is attached to a top surface of the magnet 7. The magnetic gap is formed between an outer surface of the magnet 7 and the bending portion 62 of the yoke 6. The voice coil 5 has an end suspended in the magnetic gap and another end connected with the diaphragm 4. When electrified, the voice coil is forced to move and drive the diaphragm to move upwardly and downwardly for producing sound waves.

The guiding portion 3 has a lower case 31 coupled with the side wall 14 of the frame 1, and a magnetic plate 32 fixed on the lower case 31 and near the acoustic hole 11. The lower case 31 has a bottom 33, a fitting wall 34 extending upwardly from the periphery of the bottom 33 and partially received in the engaging slot 16 of the frame 1, and a second cavity 39 formed by the fitting wall 34 together with the bottom 33 for communicating with the rear cavity 102 of the frame 1 to increasing acoustic performance of the speaker 100.

The bottom 33 has a first surface 331 near the magnetic circuit system and a second surface 332 opposite to the first surface 331. The lower case 31 further has a first fixing portion 35 extending from an outer surface of the fitting wall 34 towards the second cavity 39 and a second fixing portion 36 extending form the first surface 331 of the bottom 33 towards the second surface 332 of the bottom 33.

The magnetic plate 32 is assembled with the lower case 33 by injection molding or other assembling method. The magnetic plate 32 has a body portion 37 received in the second fixing portion 36 and exposed from the first surface 331 of the bottom 33, and a connecting portion 38 bent upwardly from the body portion 37 and received in the first fixing portion 35. The body portion 37 is exposed from the first surface 331 and directly facing an lower surface of the seating portion 61 of the yoke 6 for guiding magnetic leakage leaked from the yoke 6 and the connecting portion 38 is connected with the body portion 37 and exposed from the outer surface of the fitting portion 34 for attracting the ferromagnetic material dust, such as iron, nickel, cobalt and other metals dust, near the acoustic hole 11.

In this embodiment, the body portion of the magnetic plate is exposed from the first surface of the bottom and faced the yoke, thereby guiding magnetic leakage leaked from the yoke. But, in an alternative embodiment, the body portion is directly connected with the lower surface of the seating portion of the yoke directly or positioned in the rear cavity of the holder for guiding magnetic leakage leaked from the magnetic circuit system effectively.

The magnetic field lines always form a closed curve starting from the N-pole of the magnet and ending at the S-pole of the magnet. And, most of the magnetic field lines coming from the N-pole of the magnet flows to bending portion of the yoke through the magnetic gap via the pole plate, and then, goes into the S-pole of the magnet via the seating portion of the yoke. In this embodiment, the magnetic leakage is the magnetic field lines leaked from an outer surface of the pole plate, an outer surface of the yoke and the magnetic gap.

The guiding portion is capable of guiding the magnetic leakage leaked from the magnetic circuit system, so that the ferromagnetic material dust near the acoustic hole is attracted by the magnetic leakage, thereby the ferromagnetic material dust does not enter the front cavity via the acoustic hole. The performance of the speaker is improved.

In an alternative embodiment, the body portion can be omitted. The first fixing portion is communicated with the second cavity or rear cavity, so the connecting portion is exposed from the second fixing portion and communicated with the second cavity or rear cavity for guiding magnetic leakage leaked from the yoke directly. Or, the yoke can be omitted also. The connecting portion guides the magnetic leakage leaked from the magnet directly.

In this embodiment, the speaker with side voicing having the acoustic hole provided on the side wall of the frame and having the connecting portion exposed from the side wall and near the acoustic hole. The airflow direction of the acoustic hole is vertical to the vibrating direction of the diaphragm. But, in an alternative embodiment, the speaker with front voicing would have the acoustic hole provided on an upper surface of the frame and the connecting portion exposed from the upper surface of the frame and near the acoustic hole. The airflow direction of the acoustic hole is parallel to the to vibrating direction of the diaphragm. Because most of magnetic leakage is leaked from the rear cavity of the holder, so the performance of speaker with side voicing is better than that of the speaker with front voicing.

While the present invention has been described with reference to a specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. A speaker, comprising:

a holder having a frame having a side wall, a receiving cavity and an acoustic hole communicating with the receiving cavity, the side wall having an engaging slot near the acoustic hole;

a magnetic circuit system received in the receiving cavity of the holder; and a guiding portion attached on the holder and having a magnetic plate and a lower case coupled on the holder for fixing the magnetic plate, the magnetic plate having a connecting portion exposed from an outer surface of the holder and disposed near the acoustic hole;

wherein the guiding portion is capable of guiding magnetic leakage leaked from the magnetic circuit system to attract the ferromagnetic material dust near the acoustic hole; and wherein the lower case has a bottom, a fitting portion extending from the bottom and received in the engaging slot of the frame and a second cavity formed by the fitting wall together with the bottom; the fitting portion has a first fixing portion extending from an outer surface of the fitting portion towards the second cavity for receiving the connecting portion of the magnetic plate.

2. The speaker as described in claim 1, wherein the speaker further has a vibrating system received in the receiving cavity and divided the receiving cavity into a front cavity communicated with the acoustic hole and a rear cavity opposite to the front cavity for receiving the a magnetic circuit system, and the guiding portion is partially positioned in the rear cavity.

3. The speaker as described in claim 2, wherein the guiding portion has a magnetic plate having a body portion facing the magnetic circuit system and athe connecting portion extending from the body portion.

4. The speaker as described in claim 3, wherein the magnetic circuit system has a yoke having a seating portion and a magnet attached on the seating portion of the yoke; the body portion is faced the seating portion for guiding magnetic leakage leaked from the yoke.

5. The speaker as described in claim 3, wherein the magnetic circuit system has a yoke having a seating portion and a magnet attached on the seating portion of the yoke; the body portion is connected with the seating portion for guiding magnetic leakage leaked from the yoke.

6. The speaker as described in claim 1, wherein the bottom has a first surface near the magnetic circuit system, a second surface opposite to the first surface and a second fixing portion extending form the first surface of the bottom towards the second surface of the bottom for receiving the body portion of the magnetic plate.

7. The speaker as described in claim 2, wherein the holder further has an upper case mounted on the side wall.

* * * * *